US007316091B1

(12) United States Patent
Desomma

(10) Patent No.: US 7,316,091 B1
(45) Date of Patent: Jan. 8, 2008

(54) FIREARM BOLT CARRIER WITH MECHANICAL/GAS KEY

(76) Inventor: Frank Desomma, 23623 N. 67th Ave., Glendale, AZ (US) 85310

( * ) Notice: Subject to any disclaimer, the term of this patent is extended or adjusted under 35 U.S.C. 154(b) by 2 days.

(21) Appl. No.: 11/232,521

(22) Filed: Sep. 22, 2005

Related U.S. Application Data

(60) Provisional application No. 60/612,016, filed on Sep. 22, 2004.

(51) Int. Cl.
*F41A 3/00* (2006.01)
*F41A 3/12* (2006.01)

(52) U.S. Cl. ..... 42/16; 89/17

(58) Field of Classification Search ..... 42/16, 42/17, 19; 89/17, 19, 20.2, 21, 183, 191.01, 89/191.02, 192–194
See application file for complete search history.

(56) References Cited

U.S. PATENT DOCUMENTS 4,244,273 A * 1/1981 Langendorfer et al. ..... 89/193
4,246,830 A * 1/1981 Krieger ..... 89/179
H107 H * 8/1986 Bauer ..... 89/149
4,658,702 A * 4/1987 Tatro ..... 89/139
4,765,224 A * 8/1988 Morris ..... 89/191.01
5,183,959 A * 2/1993 McCoan et al. ..... 89/148
5,551,179 A * 9/1996 Young ..... 42/16
5,770,814 A * 6/1998 Ealovega ..... 89/131
6,070,352 A * 6/2000 Daigle ..... 42/49.02
6,209,250 B1 * 4/2001 Mills ..... 42/53
6,470,615 B1 * 10/2002 Peterken ..... 42/70.01
6,848,351 B1 * 2/2005 Davies ..... 89/191.01
6,971,202 B2 * 12/2005 Bender ..... 42/16

* cited by examiner

*Primary Examiner*—Bret Hayes
(74) *Attorney, Agent, or Firm*—Parsons & Goltry; Robert A. Parsons; Michael W. Goltry

(57) ABSTRACT

A firearm includes a barrel having an end coupled to a receiver. A reciprocating bolt carrier is carried by the receiver and movable between a locked position and an unlocked position. The bolt carrier includes a buttress formed in a top surface thereof. A key includes a base having a rearward end and is coupled to the bolt carrier with the rearward end abutting the buttress.

18 Claims, 5 Drawing Sheets

FIREARM BOLT CARRIER WITH MECHANICAL/GAS KEY

CROSS-REFERENCE TO RELATED APPLICATIONS

This application claims the benefit of U.S. Provisional Application No. 60/612,016, filed 22 Sep. 2004.

FIELD OF THE INVENTION

This invention relates to firearms.

More particularly, the present invention relates to the operating system of firearms.

BACKGROUND OF THE INVENTION

Several problems are prevalent in the art of firearm operating systems. Two main operating systems will be addressed herein. Those systems include gas operating systems and push rod operating systems. In a push rod operating system, a rod is reciprocated by gas generated through the firing of a cartridge. The rod mechanically engages a bolt carrier, pushing the bolt carrier backward after the firing of a cartridge. While this operating system works admirably, the forces applied to the bolt carrier by the push rod can be substantial. The forces can result in damage to the bolt carrier and receiver. The gas operating system also functions satisfactorily and includes a gas tube which receives gas generated through the firing of the cartridge, and directs those gases to, and against the bolt carrier. The pressures generated by the gas force the bolt carrier in the river direction similar to the push rod. In this instance, while the forces applied to the bolt carrier are lessened, lessening the chances of damage, the gases carried by the gas tube can leak into the bolt carrier fouling the firearm. Gases entering the bolt carrier in the upper receiver therefrom can deposit materials preventing the smooth operation of the firearm and eventually preventing any operation thereof.

It would be highly advantageous, therefore, to remedy the foregoing and other deficiencies inherent in the prior art.

Accordingly, it is an object the present invention to provide a new and improved operating system for a firearm.

SUMMARY OF THE INVENTION

Briefly, to achieve the desired objects of the present invention in accordance with a preferred embodiment thereof, provided is apparatus including a reciprocating bolt carrier having a buttress formed in a top surface thereof, and a key including a base having a rearward end, the key coupled to the bolt carrier with the rearward end abutting the buttress. In a specific aspect, the bolt carrier includes a pocket cut formed in the top surface thereof, extending forwardly from the buttress. The pocket cut can be defined by a continuous sidewall including the buttress.

Also provided is a firearm including a barrel having an end coupled to a receiver, a reciprocating bolt carrier carried by the receiver and movable between a locked position and an unlocked position, the bolt carrier including a buttress formed in a top surface thereof, and a key including a base having a rearward end, the key coupled to the bolt carrier with the rearward end abutting the buttress. In a specific aspect the firearm includes a push rod system having a push rod extending along a push rod tube parallel to the barrel and terminating in an engagement with the key.

In a different aspect, the firearm can include a gas operating system having a gas tube terminating in the key, the key recessed within the pocket cut.

In yet a further aspect, a firearm includes a reciprocating bolt carrier carried by the upper receiver and movable between a locked position and an unlocked position. The bolt carrier includes a buttress formed in a top surface thereof, and a cam aperture formed through a top surface thereof forwardly of the buttress. A bolt is carried by the bolt carrier. The bolt carrier has a pocket cut formed in the top surface thereof and extending forwardly from the buttress. The aperture is forward of the pocket cut, and a forward most portion of the key terminates rearward of the aperture.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
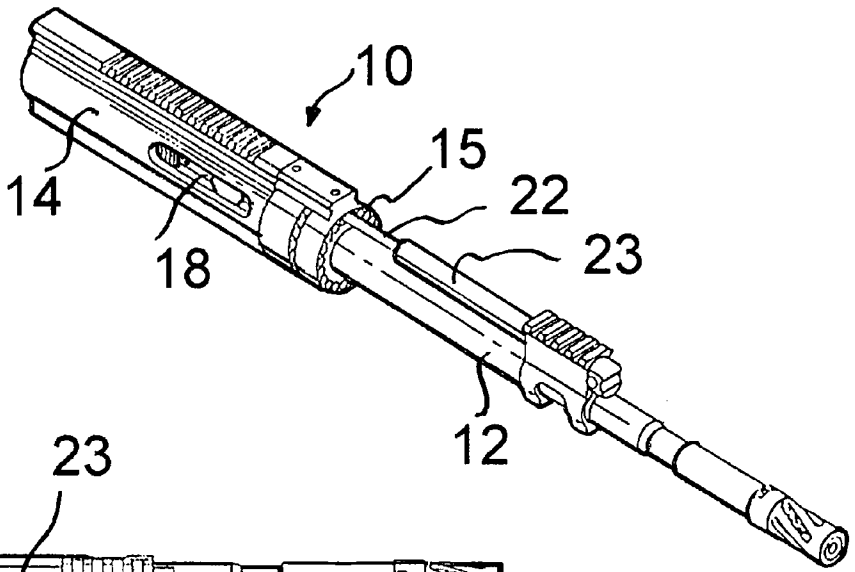
FIG. 1 is a partial perspective view of a firearm according to the present invention.
Figure 2:
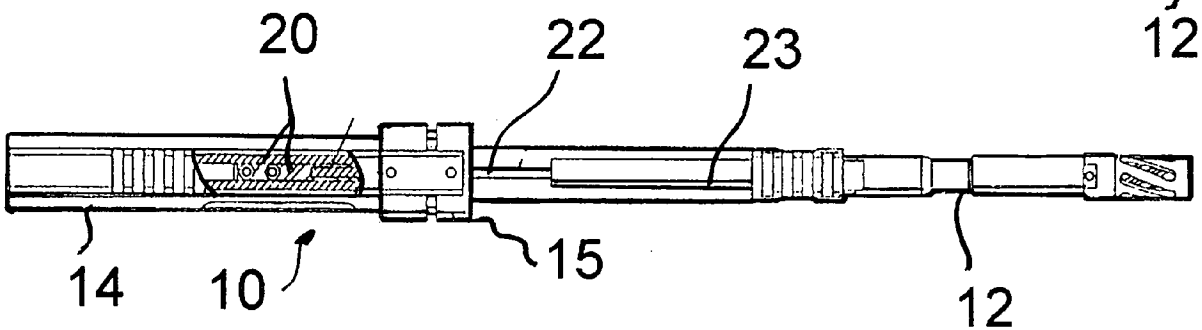
FIG. 2 is a partial top view of the firearm of FIG. 1, with portions thereof removed.
Figure 3:
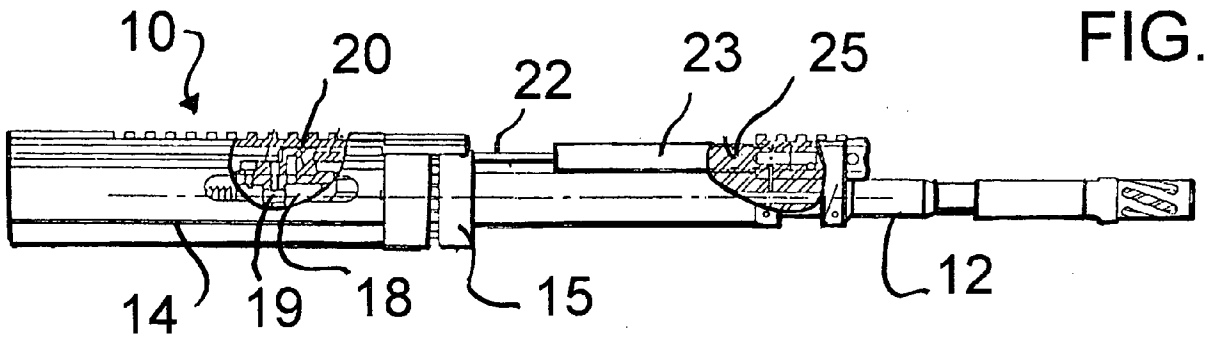
FIG. 3 is a partial side view of the firearm of FIGS. 1 and 2, with portions thereof removed.
Figure 4:
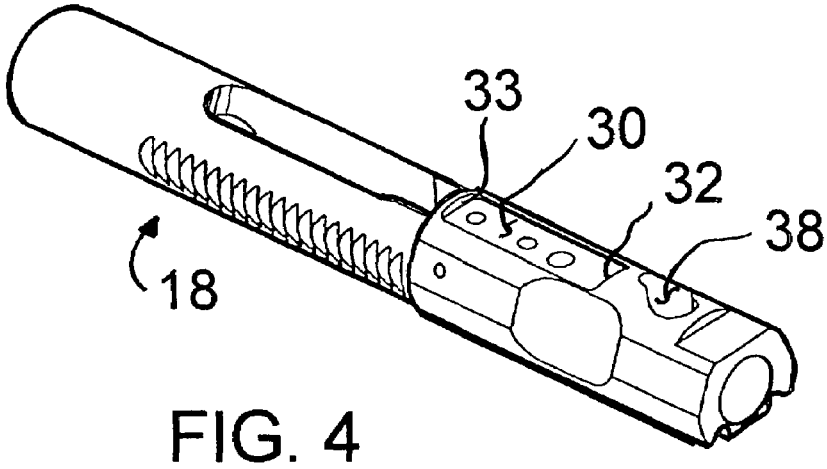
FIG. 4 is a perspective view of the bolt carrier according to the present invention.
Figure 5:
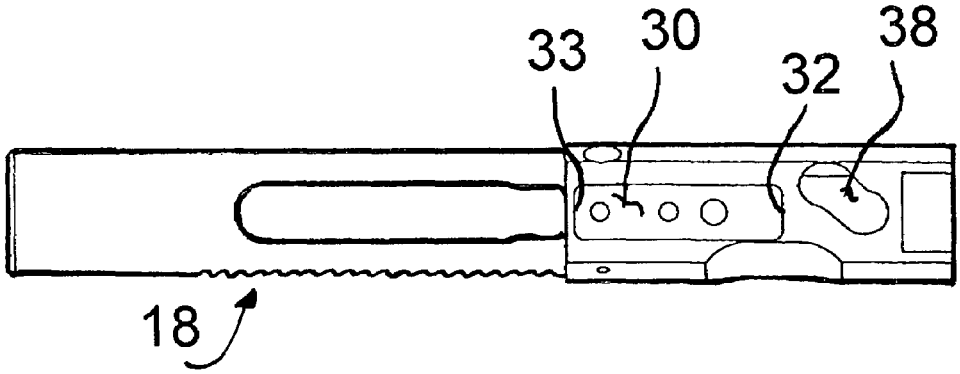
FIG. 5 is a top plan view of the bolt carrier of FIG. 4.
Figure 6:
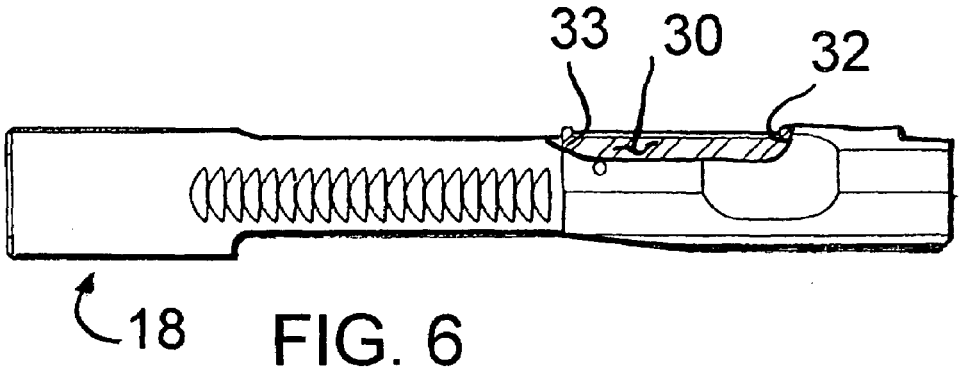
FIG. 6 is a side plan of the bolt carrier of FIGS. 4 and 5.
Figure 7:
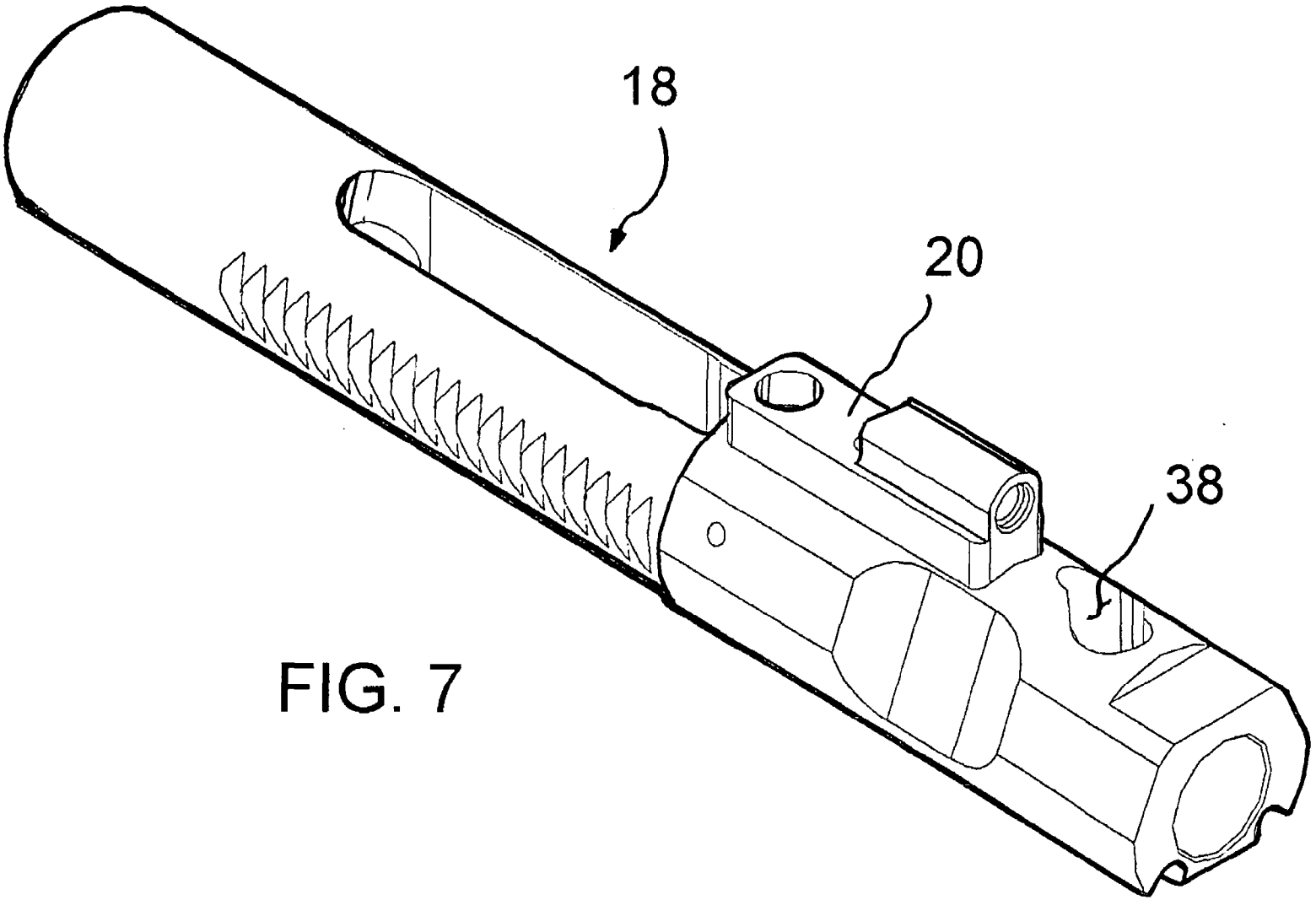
FIG. 7 is a perspective view of the bolt carrier and mechanical/gas key according to the present invention.
Figure 8:
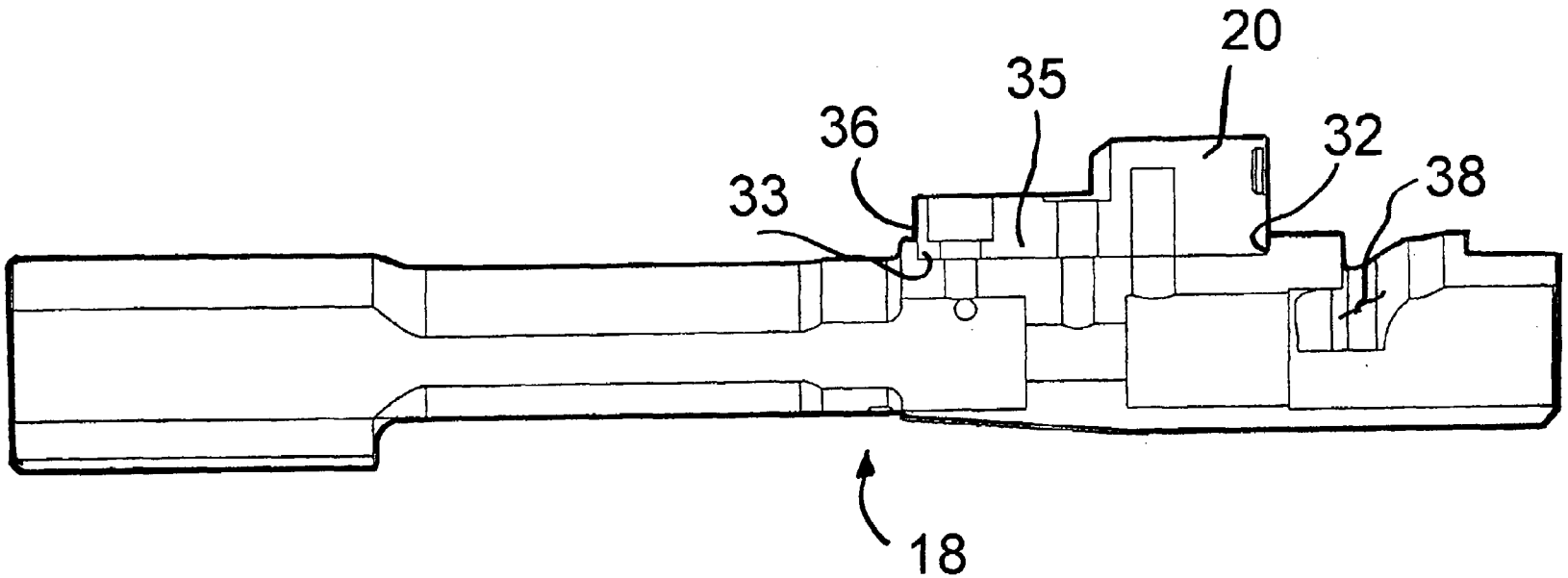
FIG. 8 is a sectional side view of the bolt carrier and mechanical/gas key of FIG. 7, illustrating the interface therebetween.

Turning now to the drawings in which like reference characters indicate corresponding elements throughout the several views, attention is directed to FIGS. 1-3 which illustrate a portion of a firearm generally designated 10. Firearm 10 may be substantially any firearm utilizing fully automatic or semiautomatic operating systems. The operating systems may employ gas or pushrods to move the bolt carrier through the firing cycle. In the embodiment illustrated, AR15 or M16 type firearms are shown. Firearm 10 includes a barrel 12 coupled to an upper receiver 14 by a barrel nut 15. Upper receiver 14 is of conventional manufacture, and carries a reciprocating bolt carrier 18 movable between a locked and an unlocked position. Bolt carrier 18 supports and positions a bolt 19. One skilled in the art will understand that the locked position is the position in which the bolt carrier positions the bolt for firing. The unlocked position is any position other than the locked position but specifically includes the position in which the bolt carrier retracts the bolt from the chamber to permit ejection of a casing and insertion of a cartridge. A mechanical/gas key 20 is coupled to bolt carrier 18 and is employed by a gas or pushrod operating system for moving bolt carrier 18 between the locked and the unlocked positions.

Still referring to FIGS. 1-3, the operating system of firearm 10 is a push rod system having a push rod 22 extending along a push rod tube 23 parallel to barrel 12 and terminating in an engagement with mechanical/gas key 20. As firearm 10 is fired, gas from the detonated round enters the push rod tube and, through the use of a piston 25, moves push rod 22 rearwardly. Rearward movement of push rod 22 pushes against key 20 moving bolt carrier 18 to the unlocked position. In a conventional firearm, similar to that disclosed, mechanical/gas key 20 is bolted to the surface of a bolt carrier, for receiving a gas tube of a gas operated system. In the preferred embodiment illustrated, a push rod system as disclosed is employed. Forces generated by the engagement of push rod 22 with mechanical/gas key 20 can result in fracturing of the junction between mechanical/gas key 20 and bolt carrier 18 if attached in a conventional manner. Stresses caused by the force of push rod 22 can overcome the hardware couplings of the mechanical/gas key and engagement with the bolt carrier. In the gas operated system, gas entering the mechanical/gas key will often leak around the junction between the key and the bolt carrier, affecting the operation of the system and increasing the fouling of the weapon, reducing the operating efficiencies.

With additional reference to FIGS. 4-8, bolt carrier 18, according to the present invention, is illustrated. Bolt carrier 18 is of substantially conventional construction with the addition of a pocket cut 30 formed in a top surface thereof, for receipt of mechanical/gas key 20. Pocket cut 30 has a forward end 32, in the direction of the muzzle of firearm 10, and a rearward end 33 or buttress, in the direction of the butt end of firearm 10. Mechanical/gas key 20 includes a base 35 received within pocket cut 30 and pinned, bolted or otherwise affixed therein. Upon application of gas force or the force from a push rod to mechanical/gas key 20, the abutting engagement between a rear 36 of base 35 against rearward end 33 absorbs the impact forces, transmitting them to bolt carrier 18, and preventing damage to the junction between mechanical/gas key 20 and bolt carrier 18.

Still referring to FIGS. 4-8 bolt carrier 18 includes a camming surface in the form of aperture 38 formed through the top surface thereof intermediate forward end 32 of pocket cut 30 and a forward end of bolt carrier 18. A cam pin (not shown) extends from the bolt carried by bolt carrier 18 and is received within aperture 38. The interaction of the cam pin and aperture 38 are not described in detail as they are well known in the art and are being described to provide a basis for orientation and positioning of key 20. Specifically, with reference to FIGS. 7 and 8, when a push rod operating system is employed, the forward most portion of key 20 terminates rearward of aperture 38 and preferably does not extend past forward end 32 of pocket cut 30. The termination of key 20 proximate a middle portion of bolt carrier 18 reduces torquing of bolt carrier 18 from the forces applied by the push rod. This allows a smoother reciprocating action to bolt carrier 18 and reduces wear and damage thereto. It will be understood that the positioning of the key can be accomplished without the requirement of a pocket cut or buttress if desired. An added benefit is that an unintentional exchange of a bolt carrier having a gas key for a mechanical key will result in an inoperable firearm. In other words, a bolt carrier with a gas key will not operate in a firearm utilizing a push rod system according to the present invention and visa versa.

In addition to providing mechanical/gas strength to the junction between mechanical/gas key 20 and bolt carrier 18, if mechanical/gas key 20 is used in a gas operating system, mechanical/gas key 20, recessed within pocket cut 30, provides a greater gas seal then does a conventional mechanical/gas key and bolt carrier arrangements. Thus, mechanical/gas key 20 seated within pocket cut 30 provides both greater structural rigidity and strength, and provides an additional seal between mechanical/gas key 20 and bolt carrier 18.

Figure 9:
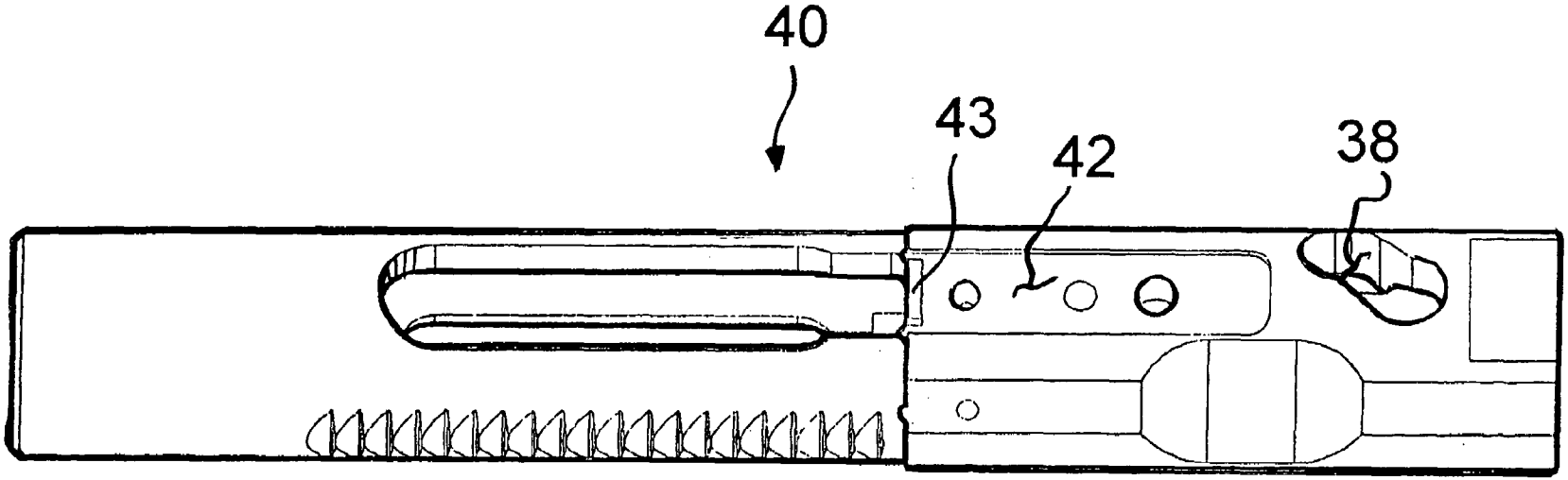
FIG. 9 is a perspective view of another embodiment of a bolt carrier having a rear buttress for engaging the mechanical/gas key.

Referring now to FIG. 9, a bolt carrier 40 is illustrated. Carrier 40 is substantially identical to carrier 18, and includes a pocket cut 42. In this embodiment, a stand alone buttress 43 is formed toward the rearward end of pocket 42. This embodiment is intended to illustrate that the rearward end of pocket 42 has a wall, buttress or other structure against which the mechanical key resides, and which absorbs the forces acting against the key to prevent excessive force from damaging the attachment between the key and the bolt carrier.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same.

The invention claimed is:

1. A firearm comprising:

a barrel having an end coupled to a receiver;

a reciprocating bolt carrier carried by the receiver and movable between a locked position and an unlocked position, the bolt carrier including a buttress formed in a top surface thereof; and a key including a base having a rearward end, the key coupled to the bolt carrier with the rearward end abutting the buttress.

2. A firearm as claimed in claim 1 wherein the bolt carrier includes a pocket cut formed in the top surface thereof, extending forwardly from the buttress.

3. A firearm as claimed in claim 2 wherein the pocket cut is defined by a continuous sidewall including the buttress.

4. A firearm as claimed in claim 3 further including a gas operating system including a gas tube terminating in the key, the key recessed within the pocket cut.

5. A firearm as claimed in claim 1 further including a push rod system having a push rod extending along a push rod tube parallel to the barrel and terminating in an engagement with the key.

6. A firearm as claimed in claim 5 wherein the bolt carrier includes a cam aperture formed through a top surface thereof forwardly of the buttress, and a forward most portion of the key terminating rearward of the aperture.

7. A firearm as claimed in claim 5 further including a pocket cut formed in the top surface thereof and extending forwardly from the buttress, the key not extending forward past a front end of the pocket cut.

8. Apparatus comprising:

a reciprocating bolt carrier having a buttress formed in a top surface thereof, and a cam aperture formed through the top surface thereof forwardly of the buttress; and a key including a base having a rearward end, the key coupled to the bolt carrier with the rearward end abutting the buttress.

9. Apparatus as claimed in claim 8 wherein the bolt carrier includes a pocket cut formed in the top surface thereof, extending forwardly from the buttress.

10. Apparatus as claimed in claim 9 wherein the pocket cut is defined by a continuous sidewall including the buttress.

11. Apparatus as claimed in claim 8 wherein a forward most portion of the key terminates rearward of the aperture.

12. A firearm comprising:

a barrel having an end coupled to an upper receiver;

a reciprocating bolt carrier carried by the upper receiver and movable between a locked position and an unlocked position, the bolt carrier including a buttress formed in a top surface thereof, and a cam aperture formed through a top surface thereof forwardly of the buttress;

a bolt carried by the bolt carrier; and a key including a base having a rearward end, the key coupled to the bolt carrier with the rearward end abutting the buttress.

13. A firearm as claimed in claim 12 wherein the bolt carrier includes a pocket cut formed in the top surface thereof, extending forwardly from the buttress.

14. A firearm as claimed in claim 13 wherein the pocket cut is defined by a continuous sidewall including the buttress.

15. A firearm as claimed in claim 14 further including a gas operating system including a gas tube terminating in the key, the key recessed within the pocket cut.

16. A firearm as claimed in claim 12 further including a push rod system having a push rod extending along a push rod tube parallel to the barrel and terminating in an engagement with the key.

17. A firearm as claimed in claim 16 further including a pocket cut formed in the top surface thereof and extending forwardly from the buttress, the aperture being forward of the pocket cut, and a forward most portion of the key terminating rearward of the aperture.

18. A firearm as claimed in claim 17 wherein the forward most portion of the key does not extend forward past a front end of the pocket cut.

* * * * *